US007914306B1

(12) United States Patent
Blackwell

(10) Patent No.: US 7,914,306 B1
(45) Date of Patent: Mar. 29, 2011

(54) ENVIRONMENTAL PROTECTIVE COVERING FOR UNIVERSAL SERIAL BUS CONNECTORS

(75) Inventor: Donald A. Blackwell, Saratoga, CA (US)

(73) Assignee: Donald A. Blackwell, Saratoga, CA (US)

( * ) Notice: Subject to any disclaimer, the term of this patent is extended or adjusted under 35 U.S.C. 154(b) by 0 days.

(21) Appl. No.: 12/901,678

(22) Filed: Oct. 11, 2010

(51) Int. Cl.
*H01R 13/44* (2006.01)

(52) U.S. Cl. ..... 439/135; 439/282; 439/588

(58) Field of Classification Search ..... 439/135, 439/136, 282, 588, 604, 521
See application file for complete search history.

(56) References Cited

U.S. PATENT DOCUMENTS

| | | | | |
|---|---|---|---|---|
| 3,120,987 | A * | 2/1964 | Degnan et al. | 439/588 |
| 5,006,078 | A * | 4/1991 | Crandall et al. | 439/521 |
| 6,358,076 | B1 * | 3/2002 | Haag | 439/320 |
| 7,407,412 | B2 * | 8/2008 | Khemakhem | 439/578 |
| 2006/0035508 | A1 * | 2/2006 | Stekelenburg | 439/369 |

* cited by examiner

*Primary Examiner* — Neil Abrams
*Assistant Examiner* — Phuongchi T Nguyen

(57) ABSTRACT

Environmental protection methods standard USB electrical connectors normally suited only for indoor use that allows said connectors to be used in the harsh outdoor environment of powersports vehicles such as motorcycles, all terrain vehicles, snowmobiles and other special purpose vehicles. The resulting environmentally protected USB electrical connectors provide a small, lightweight, easy to mount, low-cost power source for a wide variety of low power accessories as well as data transfer where available.

3 Claims, 4 Drawing Sheets

400

ENVIRONMENTAL PROTECTIVE COVERING FOR UNIVERSAL SERIAL BUS CONNECTORS

FIELD OF INVENTION

This invention relates to Universal Serial Bus (USB) connectors for motorcycles, all terrain vehicles, snowmobiles and other vehicle commonly referred to as powersports vehicles and also but not limited to other special purpose vehicle such as golf carts and powered wheel chairs.

BACKGROUND OF INVENTION

Owners and users of motorcycles, all terrain vehicles, snowmobiles, commonly called powersports vehicles and other special purpose vehicles such as golf carts and powered wheel chairs are frequently modified from their original equipment manufactured configuration to add a variety of accessories that enhance the vehicle capability and the operator's experience. These added accessories may be roughly divided into three categories: low power up to 2 amp or 20 watts, medium power of 2 to 5 amps or 20 to 60 watts and high power of 6 amps or 80 watts and greater. Examples of low power accessories may include navigation systems such as global positioning systems, cell phones, entertainment systems, radar detectors, intra-vehicle rider to passenger communication systems, inter-vehicle short range communication systems, personal digital assistants and small computers. Medium power accessories may include on-road auxiliary lighting and single articles of heated clothing. High power devices may include high intensity off-road lighting, external battery chargers and multiple articles of heated clothing A search of available vehicle accessories shows that there exist many more types of low power accessories than medium or high power accessories. Moreover, low power accessories are commonly able to be easily removed from the vehicle for personal use. For example a cell phone is normally carried on the person but can be mounted in a quick detach cradle on a vehicle for hands-free use. High power accessories are more commonly attached more permanently on the vehicle. For example high power off road lights must be mounted rigidly to ensure proper beam aiming and require special purpose wiring capable of carrying high current.

In spite of the fact that most accessories fall into the low power category, the availability of power connectors with convenient vehicle mounting methods, quick detach capability and sized for low power are non-existent in the market. Currently available accessory power connectors include DIN ISO 4165 jack/plug connector pairs, SAE two pin male/female connector pairs and cigar lighter sockets. These connector/socket systems are capable of carrying as much as 10 to 20 amps or ten times the required power levels of low power accessories. These large connectors may be acceptable for connecting low power accessories in automobiles and trucks that have large passenger compartments where space is not an issue. However, they are not well suited to the aforementioned powersports vehicles that have very limited mounting space. Moreover, some connectors such as the DIN ISO 4165 type and cigar lighters have marginal or no environmental sealing when the connection is made. Lastly, these large connectors typically require heavy mounting methods such as thick metal brackets or bulky screw clamps.

There exists a readily available compact, lightweight, low voltage Universal Serial Bus (USB) type connector that is commonly used to transmit data and power home and office electronics. Said USB Connectors would be suitable for powersports and specialty vehicle use were it not for the fact that they are designed for indoor use and have neither environmental protection nor any mounting apparatus. Both of these connector types are typically available as free-hanging cable connectors, printed circuit board mounted or as panel mounted devices for use in electrical equipment cabinets and chassis. While these configurations have been adapted to vehicle use, the results can be unsightly, awkward, and prone to environmental damage and in some cases unsafe.

In the cases where environmental protective methods have been applied to USB electrical connectors for severe usage such as military applications, the protective apparatus is comprised of heavy threaded plastic parts with internal seals and heavy caps secured to the assembly with chains or metal lanyards. These caps are free hanging when not in use and present a potential for severe vehicle bodywork damage when the vehicle is moving. While these protective methods are effective, they are not suited for powersports vehicles due to their size and awkward capping methods.

The primary object of this invention is to provide the owners and users of powersports vehicles and specialty vehicles environmental protection that allow the utilization of readily available, compact USB connector.

SUMMARY OF THE INVENTION

To achieve the above objectives, and in accordance with the purpose of the invention broadly described herein firstly, an encapsulation for USB Connectors comprising of: an encapsulated USB socket with an external sealing feature protruding from and encircling the mating end of the USB socket, a corresponding environmentally protected USB plug with an internal intrusive sealing feature shaped to fit snugly against the sealing feature of the USB socket thus providing environmental protection.

The encapsulation may be made from any resilient, weather resistant material such as synthetic rubber or a thermoplastic elastomer. The material may be of different colors for different USB connector pairs to allow the user to distinguish between different connections such as power only or power and data connection types.

The sealing feature of the USB socket or USB plug or both the USB socket and plug may be integrally formed with the encapsulation or be comprised of separate parts as will be described herein.

The encapsulated USB socket or plug may be formed as a linear shape, right angle or some intermediate angle to provide the user options for efficient cable routing.

Secondly the present invention describes a cap with a restraining lanyard that provides environmental protection for the USB socket when a USB plug connection is not present. The protective cap is so formed as to provide the same intrusive sealing feature as described for the USB plug. This type of cap is commonly used in environmentally protected electrical connections and thus is not included in the patent claims but is shown for completeness of detail.

DETAILED DESCRIPTION OF THE INVENTION

Reference will now be made in detail to the present embodiments of the invention as illustrated in the accompanying FIGS. It should be noted that no reference is made to the cabling or vehicle connections as these connections are common vehicle power and ground cables and are well known to anyone skilled in the art. In addition, strain relief features are shown on all cables but are not included as numbered items as they are common to power cables, well documented by prior art and thoroughly understood by anyone skilled in the art.

Figure 1:
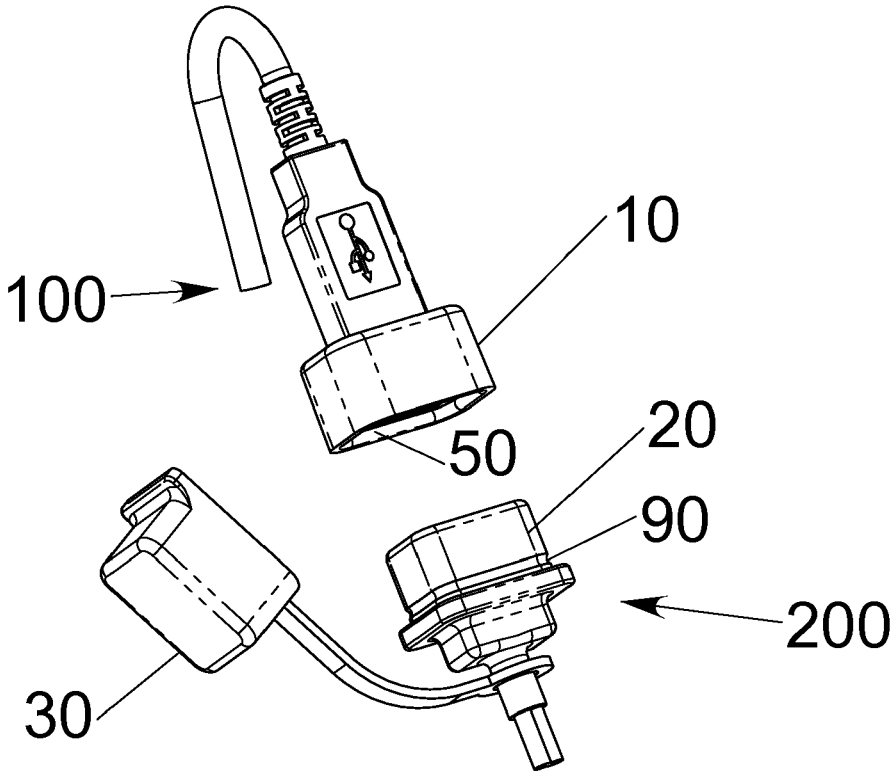
FIG. 1 shows an exploded view of a USB power male and female connector set with integrally molded environmental protective encapsulation to form an environmentally protected USB connection.

FIG. 1 shows the environmentally protected USB connector system comprised of a environmentally protected USB plug 100 and an environmentally protected USB socket 200. Environmental protection of the USB plug 100 and USB socket 200 is provided by an integrally molded encapsulation 10 made of a resilient weather resistant material such as such as synthetic rubber or thermoplastic elastomer (TPE). Said encapsulation 10 is shown as terminating in a hat section having a generally rectangular section that outlines the shape of a common USB connector body but other shapes such as hexagonal, elliptical or a combination of shapes could be employed. Said USB plug encapsulation 10 includes a sealing lip 50 oriented about the internal perimeter of said USB plug encapsulation 10 at the end most part of the body. Said sealing lip 50 shown has a generally round cross section profile for ease of mating and de-mating the corresponding connector but other shapes are possible as well. FIG. 1 also depicts the seal cap 30 which provides environmental protection when said environmentally protected USB plug 100 is not in place.

FIG. 1 also illustrates an environmentally protected USB socket 200 with a USB socket encapsulation 20 made of a resilient weather resistant material such as such as synthetic rubber or thermoplastic elastomer (TPE). Said USB socket encapsulation 20 is shown as having a generally rectangular section that outlines the shape of a common USB connector but other shapes such as hexagonal, elliptical or a combination of shapes could be employed. Said USB socket encapsulation 20 includes an integrally molded an external sealing groove 90 that is shaped to mate with the sealing lip 50 of the USB plug encapsulation 10.

Figure 2:
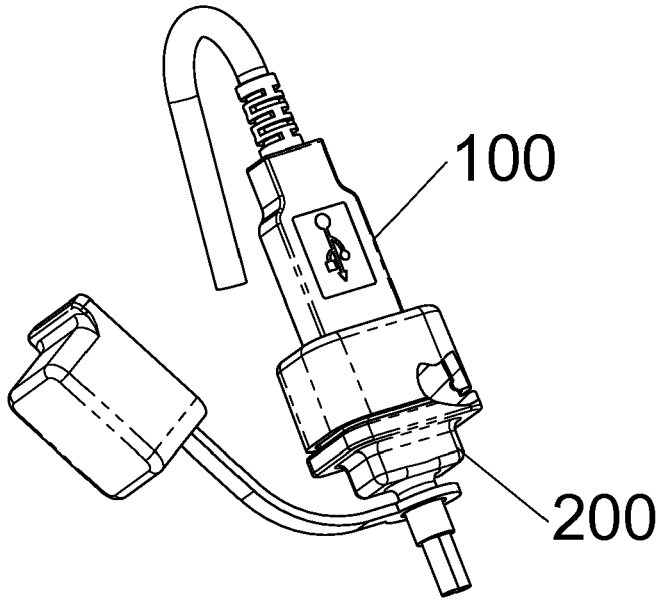
FIG. 2 shows the collapsed view of the environmentally protected USB connection.

FIG. 2 shows the assembly of the environmentally protected USB plug 100 and the environmentally protected USB socket 200. This figure also illustrates the position of the USB socket 200 within the USB plug 100.

Figure 3:
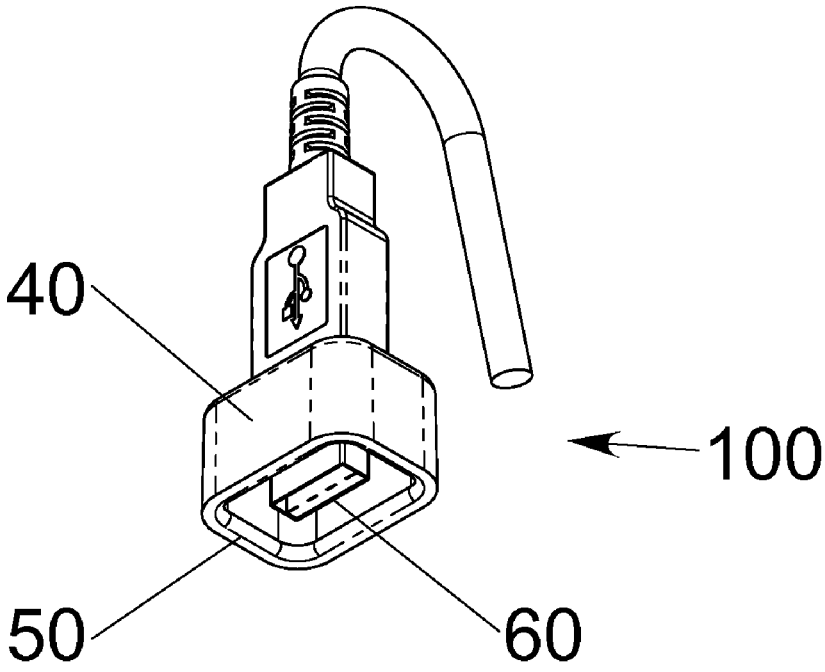
FIG. 3 shows the environmentally protected USB plug of FIG. 1 in separate detail.

FIG. 3 shows detail of the environmentally protected USB plug 100 depicting the seal skirt 40 with said sealing lip 50 located at its lower edge, shaped to mate with the sealing groove 90 of the environmentally protected USB socket 200. FIG. 3 also shows the USB standard electrical connector plug 60.

Figure 4:
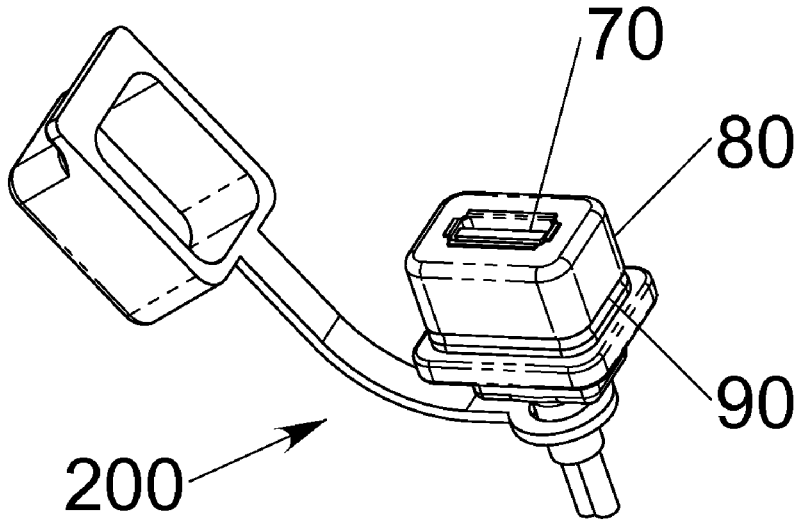
FIG. 4 shows the environmentally protected USB socket of FIG. 1 in separate detail.

FIG. 4 shows detail of the environmentally protected USB socket 200 depicting the USB standard electrical connector socket 70, the sealing surface 80 of said USB socket encapsulation 20, and said sealing groove 90 shaped to mate with said sealing lip 50 of the environmentally protected USB plug 100.

Figure 5:
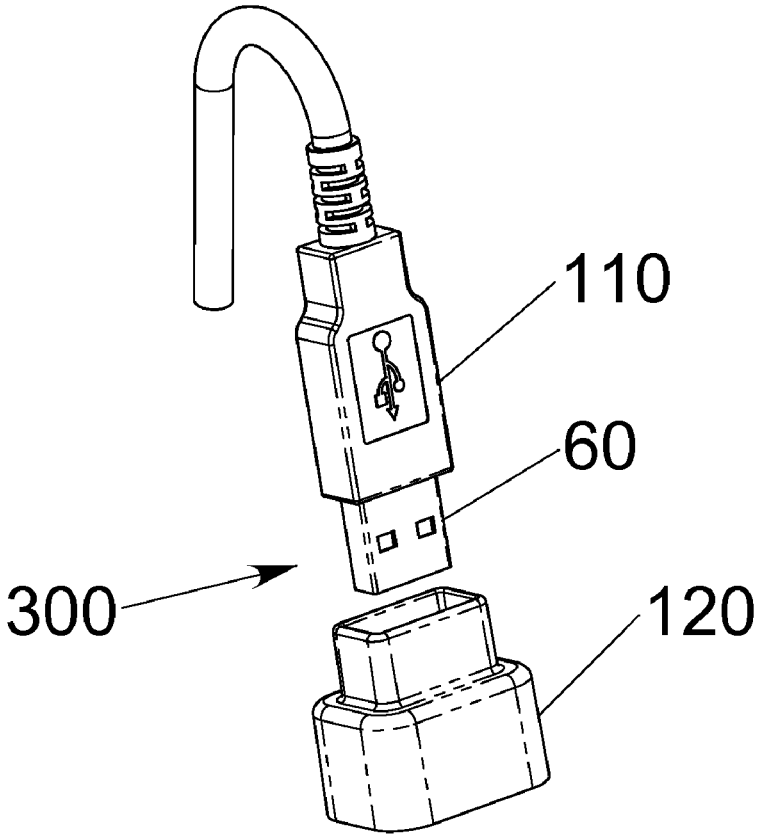
FIG. 5 shows an exploded view of an embodiment of an environmentally protected USB plug wherein the seal cap is molded as a separate part and assembled to a standard USB cable.

FIG. 5 illustrates an exploded view of an embodiment of said environmentally protected USB plug 100 wherein the seal skirt 120 is a separately molded part comprising the same sealing features of the integrally molded embodiment described above. Said separately molded seal skirt 120 provides a means of field assembling an environmentally protected USB plug 300 by attaching said seal skirt 120 to a standard USB cable 110 with its associated standard USB electrical connector plug 60.

Figure 6:
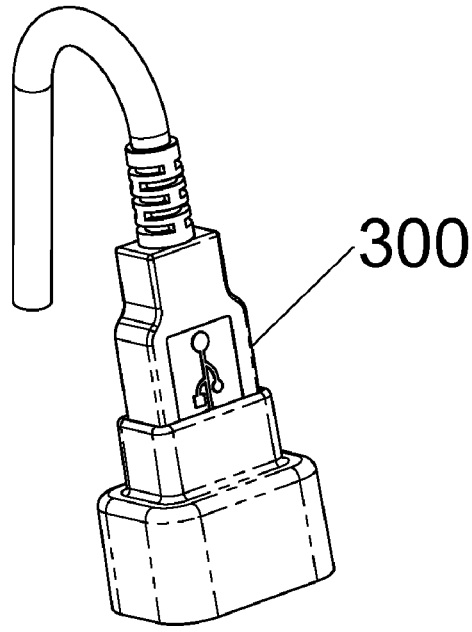
FIG. 6 shows the collapsed view of an embodiment of an environmentally protected USB plug wherein the seal cap is molded as a separate part and assembled to a standard USB cable shown in FIG. 5.

FIG. 6 shows the collapse view of field assembled environmentally protected USB plug 300 illustrating how said seal skirt fits over the standard USB cable 110 to form a single part.

FIG. 6 illustrates an embodiment of an environmentally protected USB socket 400 wherein features provide a method for mounting on a panel such as a vehicle dashboard or fairing. Said panel mount environmentally protected USB socket 400 is comprised of a socket encapsulation 130 having a generally rectangular section that outlines the shape of a common USB connector but other shapes such as hexagonal, elliptical or a combination of shapes could be employed. Said USB socket encapsulation 130 includes the same features as the environmentally protected USB socket 200 including said USB standard electrical connector socket 70, said sealing surface 80 of said USB socket encapsulation 130, and said sealing groove 90 shaped to mate with said sealing lip 50 of the environmentally protected USB plug 100.

FIG. 6 also shows a threaded cylinder 160 affixed adjacent to said USB socket encapsulation 130 and panel nut 150 which provide mounting capability for said panel mount environmentally protected USB socket 400. A panel mount seal cap 140 provides sealing when said environmentally protected USB plug 100 is not installed.

Figure 7:
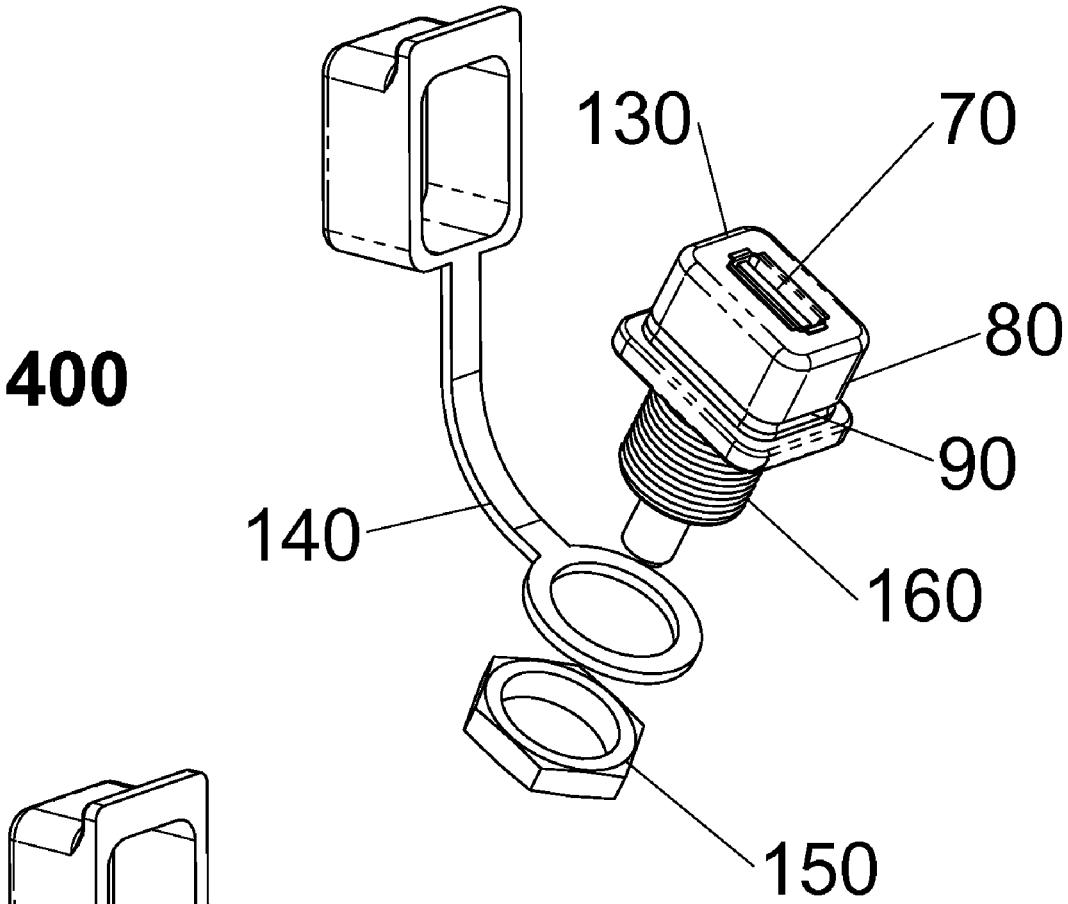
FIG. 7 shows an exploded view of an embodiment wherein the environmentally protected USB socket is configured to mount to a panel.
Figure 8:
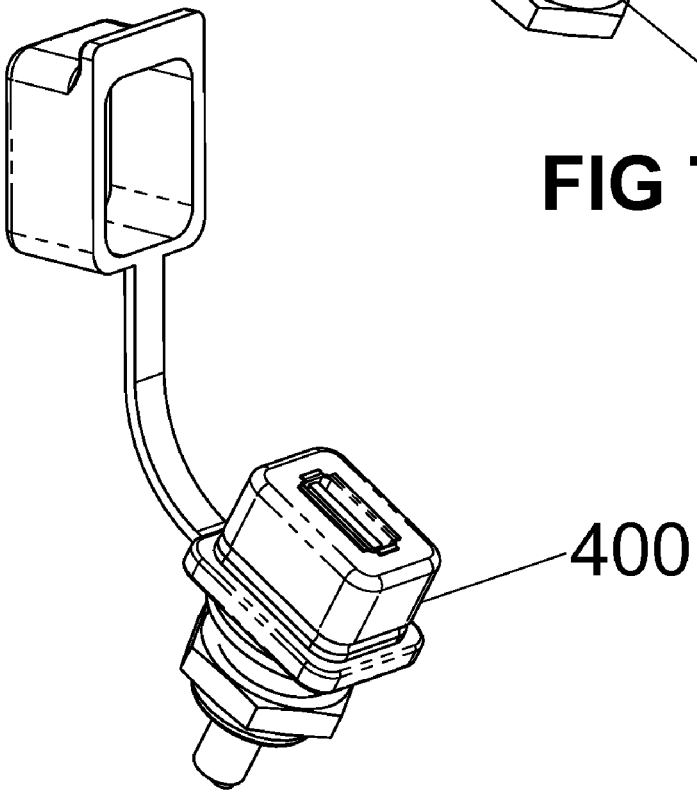
FIG. 8 shows a collapsed view of the panel mount embodiment of environmentally protected USB socket.

FIG. 7 shows the collapsed view of said panel mount environmentally protected USB socket 400.

It is evident from the above description, a wide variety of connector configurations may be fashioned from the present invention. Different USB plug and jack sizes may be encapsulated in a variety of shapes using different materials to meet the needs of differing connection types and vehicle fitments. Accordingly, additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An integrally molded environmental protective encapsulation covering a USB connector socket so as to form a single encapsulated part, allowing said USB connector socket, normally only suitable for indoor use, to be utilized on outdoor vehicle applications wherein said environmental protective encapsulation is comprised of:

a) said integrally molded environmental protective encapsulation separately covering said USB connector socket and associated wire cable from a point adjacent to the mating surface of said USB connector plug connector to a point extending past said wire cable, so as to form a single encapsulated part;

b) an integrally molded external seal element that covers said USB connector socket and located adjacent to the mating end point of said encapsulation forming a perimeter sealing surface element inversely shaped so as to conform in a closely fitting male/female manner with a corresponding seal feature of a mating component;

c) a threaded cylinder affixed adjacent to said USB socket encapsulation and panel nut which provide mounting capability for said panel mount environmentally protected USB socket; a panel mount seal cap provides sealing when said environmentally protected USB plug is not installed.

2. The external seal element of claim 1 wherein said external seal element is a separately molded part.

3. An integrally molded environmental protective encapsulation covering a USB connector socket so as to form a single encapsulated part, allowing said USB connector socket, normally only suitable for indoor use, to be utilized on outdoor vehicle applications wherein said environmental protective encapsulation is comprised of:

a) said integrally molded environmental protective encapsulation separately covering said USB connector socket and associated wire cable from a point adjacent to the mating surface of said USB connector plug connector to a point extending past said wire cable, so as to form a single encapsulated part;

b) an integrally molded external seal element that covers said USB connector socket and located adjacent to the mating end point of said encapsulation forming a perimeter sealing surface element inversely shaped so as to conform in a closely fitting male/female manner with a corresponding seal feature of a mating component;

c) an integrally molded threaded element collocated in an axial orientation at the lower extremity of said environmental protective encapsulation covering so as to form a single part suitable for mounting on a panel surface;

d) a threaded cylinder affixed adjacent to said USB socket encapsulation and panel nut which provide mounting capability for said panel mount environmentally protected USB socket; a panel mount seal cap provides sealing when said environmentally protected USB plug is not installed.

* * * * *